US011031174B2

(12) United States Patent
Kim et al.

(10) Patent No.: US 11,031,174 B2
(45) Date of Patent: Jun. 8, 2021

(54) THIN FILM TYPE INDUCTOR

(71) Applicant: SAMSUNG ELECTRO-MECHANICS CO., LTD., Suwon-si (KR)

(72) Inventors: Jae Hun Kim, Suwon-si (KR); Boum Seock Kim, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 485 days.

(21) Appl. No.: 15/985,081

(22) Filed: May 21, 2018

(65) Prior Publication Data

US 2019/0115142 A1 Apr. 18, 2019

(30) Foreign Application Priority Data

Oct. 16, 2017 (KR) ..... 10-2017-0134150

(51) Int. Cl.
*H01F 27/29* (2006.01)
*H01F 27/28* (2006.01)
(Continued)

(52) U.S. Cl.
CPC ..... *H01F 27/2804* (2013.01); *H01F 17/0013* (2013.01); *H01F 27/29* (2013.01);
(Continued)

(58) Field of Classification Search
CPC ..... H01F 17/0013; H01F 27/2804; H01F 27/292; H01F 2027/2809; H01F 27/2828;
(Continued)

(56) References Cited

U.S. PATENT DOCUMENTS 5,937,381 A * 8/1999 Huang ..... G10L 17/24 704/247
6,185,068 B1 * 2/2001 Fujita ..... G11B 5/313 360/123.41
(Continued)

FOREIGN PATENT DOCUMENTS

CN 106205973 A 12/2016
CN 109509610 A 3/2019
(Continued)

OTHER PUBLICATIONS

Korean Office Action dated Nov. 8, 2018 issued in Korean Patent Application No. 10-2017-0134150 (with English translation).
(Continued)

*Primary Examiner* — Alexander Talpalatski
*Assistant Examiner* — Joselito S. Baisa
(74) *Attorney, Agent, or Firm* — Morgan, Lewis & Bockius LLP

(57) ABSTRACT

A thin film type inductor includes: a body including a support member including a through hole, upper and lower coils disposed on upper and lower surfaces of the support member, respectively, and a via penetrating through the support member while connecting the upper and lower coils to each other; and external electrodes disposed on an external surface of the body. A coil pattern directly connected to the via may include an inclined surface.

19 Claims, 5 Drawing Sheets

(51) Int. Cl.

| | |
|---|---|
| ***H01F 41/04*** | (2006.01) |
| ***H01F 27/32*** | (2006.01) |
| ***H01F 17/00*** | (2006.01) |
| *H01F 17/04* | (2006.01) |

(52) U.S. Cl.
CPC ..... *H01F 27/292* (2013.01); *H01F 27/327* (2013.01); *H01F 41/042* (2013.01); *H01F 41/046* (2013.01); *H01F 2017/048* (2013.01); *H01F 2027/2809* (2013.01)

(58) Field of Classification Search
CPC ..... H01F 27/324; H01F 2017/002; H01F 27/323; H01F 27/327
USPC ..... 336/192
See application file for complete search history.

(56) References Cited

U.S. PATENT DOCUMENTS

| | | | | |
|---|---|---|---|---|
| 7,211,289 | B2 * | 5/2007 | Larnerd | H05K 1/115 427/96.9 |
| 7,498,919 | B2 * | 3/2009 | Fujiwara | H01F 17/0033 336/200 |
| 7,548,430 | B1 * | 6/2009 | Huemoeller | H01L 24/97 361/760 |
| 8,413,324 | B2 * | 4/2013 | Noda | H05K 3/0038 29/852 |
| 9,029,962 | B1 * | 5/2015 | Dreiza | H01L 27/04 257/416 |
| 9,928,953 | B2 * | 3/2018 | Jeon | H01F 27/255 |
| 9,960,328 | B2 * | 5/2018 | Clark | H01L 24/00 |
| 10,056,181 | B2 * | 8/2018 | Yosui | H01F 27/24 |
| 2006/0001520 | A1 | 1/2006 | Kaji et al. | |
| 2007/0222550 | A1 * | 9/2007 | Fujiwara | H01F 17/0033 336/200 |
| 2008/0003408 | A1 * | 1/2008 | Masai | H01L 23/5227 428/161 |
| 2011/0140564 | A1 * | 6/2011 | Nomura | H02K 3/26 310/208 |
| 2013/0300529 | A1 * | 11/2013 | Chang | H01F 27/292 336/173 |
| 2015/0325510 | A1 | 11/2015 | Choi et al. | |
| 2016/0071643 | A1 | 3/2016 | Heo | |
| 2017/0040101 | A1 | 2/2017 | Jeong | |
| 2019/0088402 | A1 | 3/2019 | Kim et al. | |
| 2020/0335254 | A1 | 10/2020 | Park et al. | |

FOREIGN PATENT DOCUMENTS

| | | | |
|---|---|---|---|
| JP | 4012526 | B2 | 11/2007 |
| JP | 2017-17140 | A | 1/2017 |
| KR | 10-1999-0066108 | A | 8/1999 |
| KR | 10-2015-0127999 | A | 11/2015 |
| KR | 10-2016-0029293 | A | 3/2016 |
| KR | 10-2017-0003432 | A | 9/2017 |
| KR | 10-2017-0108390 | A | 9/2017 |
| TW | 201735066 | A | 10/2017 |

OTHER PUBLICATIONS

Office Action issued in corresponding Chinese Patent Application No. 201811113516.1 dated Nov. 4, 2020, with English translation.

* cited by examiner

13 { 131, 132 }

14 { 141a, 141b1~141b5, 142b1~142b5 }

THIN FILM TYPE INDUCTOR

CROSS-REFERENCE TO RELATED APPLICATION(S)

This application is based on and claims the benefit of priority to Korean Patent Application No. 10-2017-0134150 filed on Oct. 16, 2017 in the Korean Intellectual Property Office, the entire disclosure of which is incorporated herein by reference.

TECHNICAL FIELD

The present disclosure relates to a thin film type inductor, and more particularly, to a thin film type power inductor advantageous for high inductance and miniaturization.

BACKGROUND

In accordance with the development of information technology (IT), apparatuses have been rapidly miniaturized and thinned. Therefore, market demand for small, thin devices has increased.

Korean Patent Laid-Open Publication No. 10-1999-0066108 provides a power inductor including a substrate having a via hole and coils disposed on opposite surfaces of the substrate and electrically connected to each other by the via hole of the substrate, in accordance with such a technical trend to provide an inductor including coils having uniform and high aspect ratios.

Further, in a design of the power inductor, generally, upper and lower coils are connected to each other by filling a via hole. Here, a line width of a via hole pad portion may be designed to be wider than that of other coil patterns. Therefore, a plating layer in the vicinity of the pad portion may grow rapidly, as compared to other coil patterns, and when an additional planarization process is not subsequently performed, it may be difficult to provide a plating pattern having a desired thickness without a plating deviation.

SUMMARY

An aspect of the present disclosure may provide a thin film type inductor in which a plating deviation is decreased by controlling line widths of upper and lower coil patterns directly connected to a via hole not to excessively grow as compared to a line width of other coil patterns.

According to an aspect of the present disclosure, a thin film type inductor may include: a body including an internal coil including a plurality of coil patterns, a support member supporting the internal coil, and a magnetic material encapsulating the internal coil and the support member, the body having upper and lower surfaces facing each other in a thickness (T) direction, first and second end surfaces in a length (L) direction, and first and second side surfaces in a width (W) direction; and external electrodes disposed on an external surface of the body and electrically connected to the internal coil. The internal coil may include an upper coil and a lower coil disposed on upper and lower surfaces of the support member, respectively, in the thickness direction. The upper and lower coils may be connected to each other by a via penetrating through the support member. A plurality of first coil patterns forming the upper coil and a plurality of second coil patterns forming the lower coil may include an upper connection pattern and a lower connection pattern, respectively, which are directly connected to the via. At least one of an upper portion of the upper connection pattern and an upper portion of the lower connection pattern may include an inclined surface.

According to another aspect of the present disclosure, a thin film type inductor may include: a body including an internal coil including a plurality of coil patterns, a support member supporting the internal coil, and a magnetic material encapsulating the internal coil and the support member, the body having upper and lower surfaces facing each other in a thickness (T) direction, first and second end surfaces in a length (L) direction, and first and second side surfaces in a width (W) direction; and external electrodes disposed on an external surface of the body and electrically connected to the internal coil. The internal coil may include an upper coil and a lower coil disposed on upper and lower surfaces of the support member, respectively, in the thickness direction. The upper and lower coils may be connected to each other by a via penetrating through the support member. A plurality of first coil patterns forming the upper coil and a plurality of second coil patterns forming the lower coil may include an upper connection pattern and a lower connection pattern, respectively, which are directly connected to the via. Each of the upper and lower connection patterns may include an upper region and a lower region, the upper region located at a farther side from the support member, the lower region located at a nearer side to the support member and directly connected to the via. A cross section of the lower region of at least one of the upper and lower connection patterns in a width-thickness (W-T) direction may have a rectangular shape, and a cross section of the upper region of at least one of the upper and lower connection patterns in the width-thickness (W-T) direction may have a trapezoidal shape, which has a decreasing width in the width direction from the nearer side to the farther side of the support member.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a thin film type inductor according to an exemplary embodiment in the present disclosure will be described, but is not necessarily limited thereto.

Figure 1:
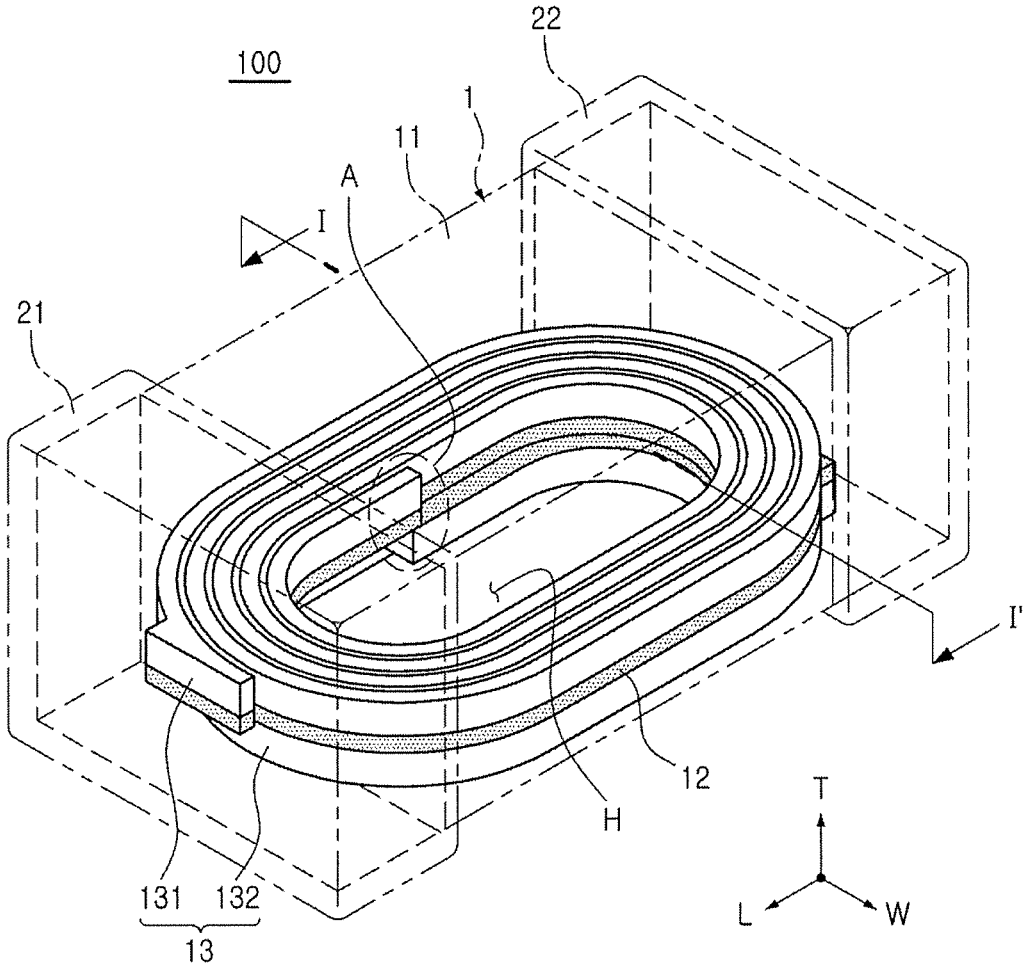
FIG. 1 is a schematic perspective view of a thin film type inductor according to an exemplary embodiment in the present disclosure.
Figure 2:
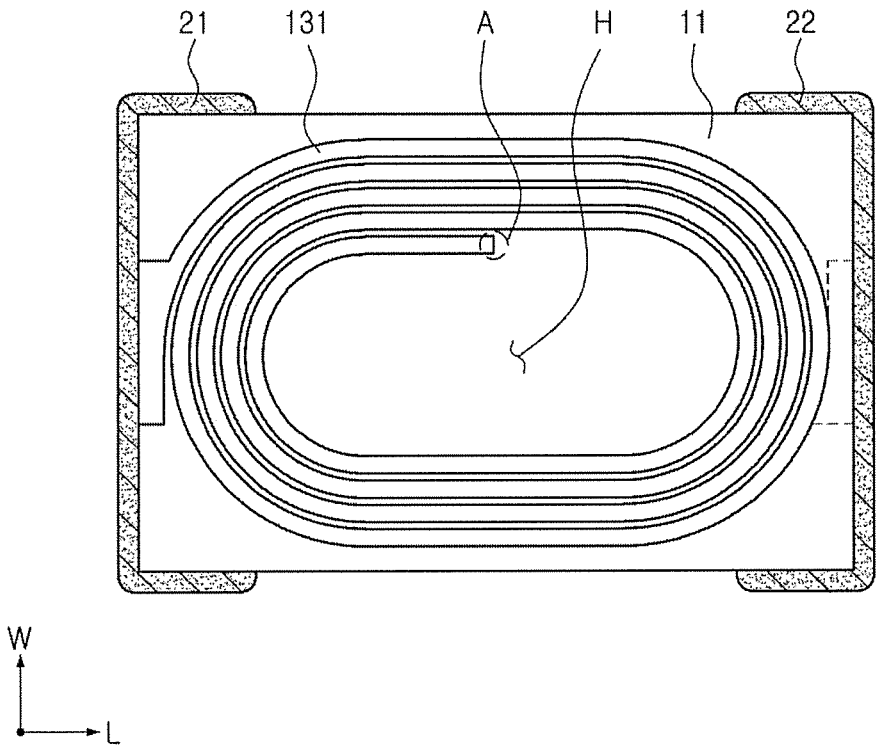
FIG. 2 is a plan view of an internal coil of FIG. 1.

FIG. 1 is a schematic perspective view of a thin film type inductor 100 according to an exemplary embodiment in the present disclosure, and FIG. 2 is a schematic plan view of an internal coil of FIG. 1.

Referring to FIGS. 1 and 2, the thin film type inductor 100 may include a body 1 and external electrodes 21 and 22 disposed on an external surface of the body.

Next, the body 1 may form an exterior of the thin film type inductor, have upper and lower surfaces opposing each other in a thickness (T) direction, first and second end surfaces opposing each other in a length (L) direction, and first and second side surfaces opposing each other in a width (W) direction, and be substantially hexahedron. However, an external shape of the body is not limited.

The body 1 may contain a magnetic material 11 having magnetic properties. Here, as the magnetic material 11, any material may be used as long as it has magnetic properties. For example, the magnetic material 11 may be ferrite or a material in which metal magnetic particles are filled in a resin, wherein the metal magnetic particle may contain one or more selected from the group consisting of iron (Fe), silicon (Si), chromium (Cr), aluminum (Al), and nickel (Ni).

The magnetic material 11 may serve as an encapsulant encapsulating a support member 12 to be described below and an internal coil 13 supported by the support member 12.

The first and second external electrodes 21 and 22 may be connected to lead portions of the internal coil 13 exposed to the first and second end surfaces of the body opposing each other in the length direction, respectively. The first and second external electrodes may be formed to be extended to the upper and lower surfaces and the first and second side surfaces of the body adjacent to the first and second end surfaces of the body as well as the first and second end surfaces thereof to thereby entirely have an alphabet C shape, but are not limited thereto. That is, the first and second external electrodes may also be formed of L-shaped electrodes or bottom-surface electrodes.

Referring to FIGS. 1 and 2, a region A including a coil pattern in the vicinity of a via connecting upper and lower coils 131 and 132 of the internal coil 13 to each other is illustrated. The region A illustrates that the thin film type inductor 100 according to the present disclosure includes a coil pattern having a substantially uniform line width as compared to a thin film type inductor according to the related art. Since the line width of the coil pattern in the region A is substantially the same as that of other coil patterns, it may be appreciated that a plating deviation between the coil patterns is not large. This may be appreciated from the fact that generally, in a case of designing a coil pattern to have a wide line width at a specific point, at the time of plating the coil pattern, since a plating growth rate at the specific point is faster than a plating growth rate at other points, over-plating of the coil pattern occurs at the specific point. When the over-plating occurs at the specific point as described above, only in a case of adjusting the thickness of the coil pattern to be uniform using a separate method such as a polishing method, or the like, the coil pattern having a uniform thickness may be obtained. Meanwhile, as illustrated in the region A of FIGS. 1 and 2, since the line width of the coil pattern in the vicinity of the via is substantially the same as that of other points, a filling rate of the magnetic material 11 filled in a through hole H may be increased.

Next, a specific shape of a plurality of coil patterns including the region A of FIGS. 1 and 2 will be described in more detail with reference to FIG. 3.

Figure 3:
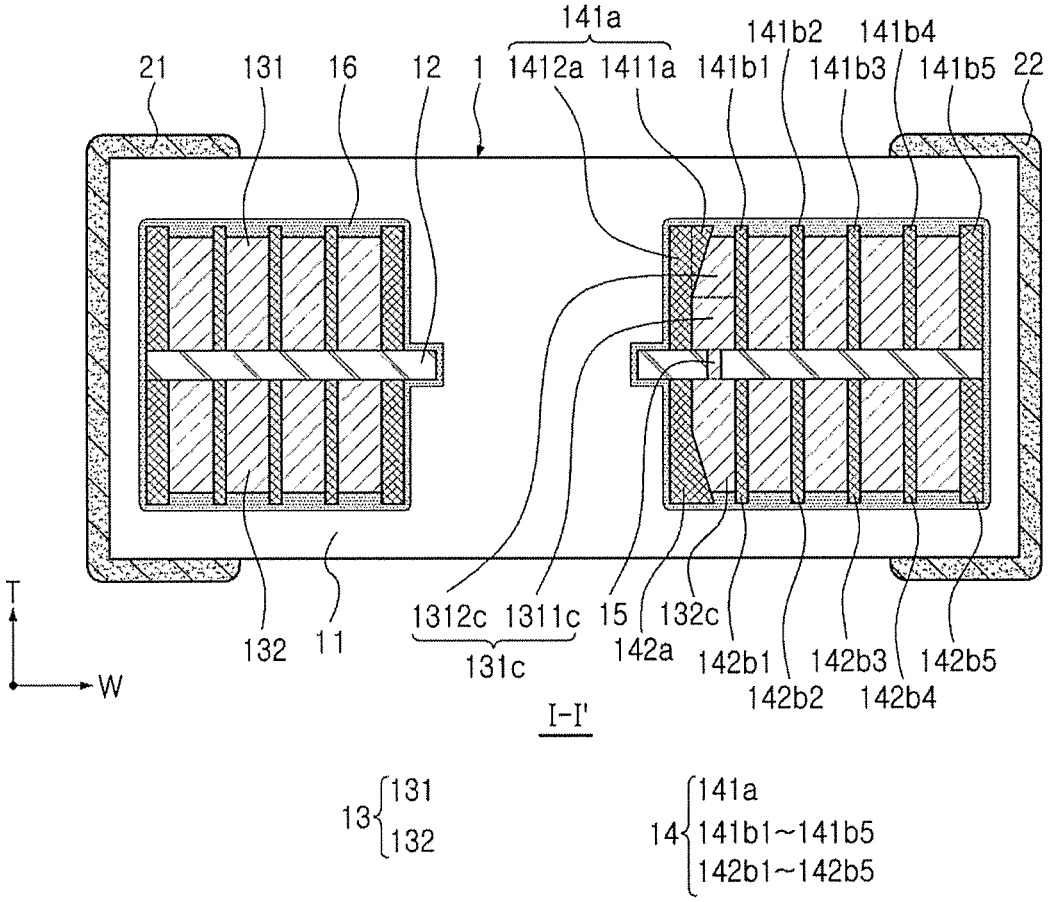
FIG. 3 is a schematic cross-sectional view taken along line I-I' of FIG. 1.

FIG. 3 is a schematic cross-sectional view taken along line I-I' of FIG. 1. Referring to FIG. 3, the internal coil 13 may include the upper coil 131 supported on an upper surface of the support member and the lower coil supported on a lower surface of the support member based on the support member 12. Meanwhile, since a detailed description of the upper coil 131 may be applied to the lower coil 132 as it is, hereinafter, for convenience of explanation, a separate description of the lower coil 132 will be omitted.

A through hole H and a via hole spaced apart from the through hole H by a predetermined distance may be included in the support member 12. As described above, the magnetic material 11 may be filled in the through hole H, and the via hole may be filled with a conductive material to form a via 15. Here, the via 15 may serve to connect the upper and lower coils 131 and 132 to each other.

The via 15 may be directly connected to an upper connection pattern 131*c* among the plurality of coil patterns of the upper coil 131 and directly connected to a lower connection pattern 132*c* among the plurality of coil patterns of the lower coil. In this case, a connection structure between the via 15 and the upper connection pattern 131*c* and between the via 15 and the lower connection pattern 132*c* may be suitably selected by those skilled in the art in consideration of process conditions and desired characteristics. For example, the via 15 may be formed so that a side surface of the via hole is enclosed by a seed pattern and a portion of the via 15 penetrating through the via hole is formed integrally with the upper and lower connection patterns 131*c*, 132*c* without a boundary line therebetween, but is not limited thereto.

The upper connection pattern 131*c* directly connected to the via 15 may include lower and upper regions 1311*c* and 1312*c*. Although the upper and lower regions 1311*c* and 1312*c* are formed integrally with each other without a boundary line therebetween, for convenience of explanation, these regions are illustrated as configurations distinguished from each other. A cross section of the lower region 1311*c* of the upper connection pattern 131*c* in a width-thickness (W-T) direction may have a rectangular shape. Since an insulating part 14 insulating the plurality of coil patterns from each other serves as a guide of the upper connection pattern 131*c*, the cross section described above may be obtained. Since the insulating part 14 is prepared before a plating process for the internal coil 13 is performed, the internal coil 13 may grow only in a space in an opening portion prepared in the insulating part 14. As a result, the lower region 1311*c* of the upper connection pattern 131*c* may grow so as to have a rectangular cross section.

Next, a cross section of the upper region 1312*c* of the upper connection pattern 131*c* in the width-thickness (W-T) direction may have a trapezoidal shape. One surface of the upper region 1312*c* may be an inclined surface, which inclines toward a center of a core of the internal coil 13, and a method of forming the inclined surface is not limited, but for example, the inclined surface may be formed by performing exposure and development at least two times. As a specific example, after laminating an insulating sheet on the support member, performing primary exposure, and subsequently performing secondary exposure, development may be performed. At the time of performing the primary exposure, exposure may be performed at an exposure amount of 1000 mJ/cm$^2$ to 3000 mJ/cm$^2$, and the secondary exposure may be additionally performed only on a region in which the inclined surface will be formed. In this case, it is suitable that an exposure amount of the secondary exposure is selected in a range of 2.5% to 15% of the exposure amount of the primary exposure, and may be preferably about 50 mJ/cm$^2$ to 400 mJ/cm$^2$. The inclined surface may be substantially formed by additionally performing the secondary exposure. An inclined angle of the inclined surface or a maximum width of the inclined surface may be suitably determined by those skilled in the art.

A width W1 of an edge of the upper connection pattern 131*c* coming into contact with the support member 12 may be wider than a width W2 of an upper surface of the upper connection pattern 131*c* in parallel with the support member 12. A width W3 of an edge of the lower connection pattern 132*c* coming into contact with the support member 12 may be wider than a width W4 of an upper surface of the lower connection pattern 132*c* in parallel with the support member 12.

A width W1 of an edge of the upper connection pattern 131*c* coming into contact with the support member 12 may be substantially equal to a maximum width of a coil pattern closest to the upper connection pattern 131*c* among the plurality of coil patterns forming the upper coil 131. A width W3 of an edge of the lower connection pattern 132*c* coming into contact with the support member 12 is substantially equal to a maximum width of a coil pattern closest to the lower connection pattern 132*c* among the plurality of coil patterns forming the lower coil 132. When the cross section of the upper region 1312*c* of the upper connection pattern 131*c* in the width-thickness (W-T) direction has the trapezoidal shape, an innermost insulating part 141*a* disposed to be adjacent to the center of a magnetic core of the internal coil 13 while coming into contact with the inclined surface of the upper region 1312*c* of the upper connection pattern 131*c* may also have an inclined surface corresponding to the inclined surface of the upper region 1312*c*. The innermost insulating part 141*a* may be composed of a basic insulating part 1412*a* and a remaining insulating part 1411*a* including the inclined surface. The remaining insulating part 1411*a* may be formed by secondary exposure. The remaining insulating part 1411*a* may serve to prevent over-plating of the upper connection pattern, and since the remaining insulating part 1411*a* serves as a guide for plating growth, the remaining insulating part 1411*a* may serve to control the over-growth of the upper connection pattern 131*c* in the width or thickness direction. As a result, the upper connection pattern 131*c* may not have an over-plating growth defect in the upper region 1312*c* thereof while having the lower region 1311*c* wide enough to prevent an open failure of the via 15 from occurring.

The insulating part 14 may further include insulating parts 141*b*1, 141*b*2, 142*b*3, 142*b*4, and 142*b*5 serving as growth guides of the coil pattern in addition to the innermost insulating part 141*a* disposed in an innermost portion of the insulating part 14. The insulating parts 141*b*1, 141*b*2, 142*b*3, 142*b*4, and 142*b*5 may be formed simultaneously with forming the basic insulating part 1412*a* of the innermost insulating part 141*a*. A coil pattern having a high aspect ratio may be stably formed by the insulating parts 141*b*1, 141*b*2, 142*b*3, 142*b*4, and 142*b*5. Cross sections of the insulating parts 141*b*1, 141*b*2, 142*b*3, 142*b*4, and 142*b*5 in the W-T direction may have a rectangular shape, but a design for the cross-sectional shape thereof may be suitably changed into a suitable shape by those skilled in the art at the time of exposure.

In addition, an additional insulating part 16 may be further disposed on the insulating part 14. The additional insulating part 16 may be a configuration for insulation between the upper surface of the coil pattern and the magnetic material 11, but may be simultaneously disposed on the insulating part 14, such that a double insulation effect may be implemented. A method of forming the additional insulating part 16 is not limited. For example, the additional insulating part may be formed by laminating an insulating sheet. There is no need to use a photosensitive insulating material as a material of the additional insulating part 16, but any material may be used as long as it has insulation properties. On the contrary, since the insulating part 14 needs to be subjected to exposure and development, it is advantageous to form the insulating part 14 using the photosensitive insulating material.

Figure 4:
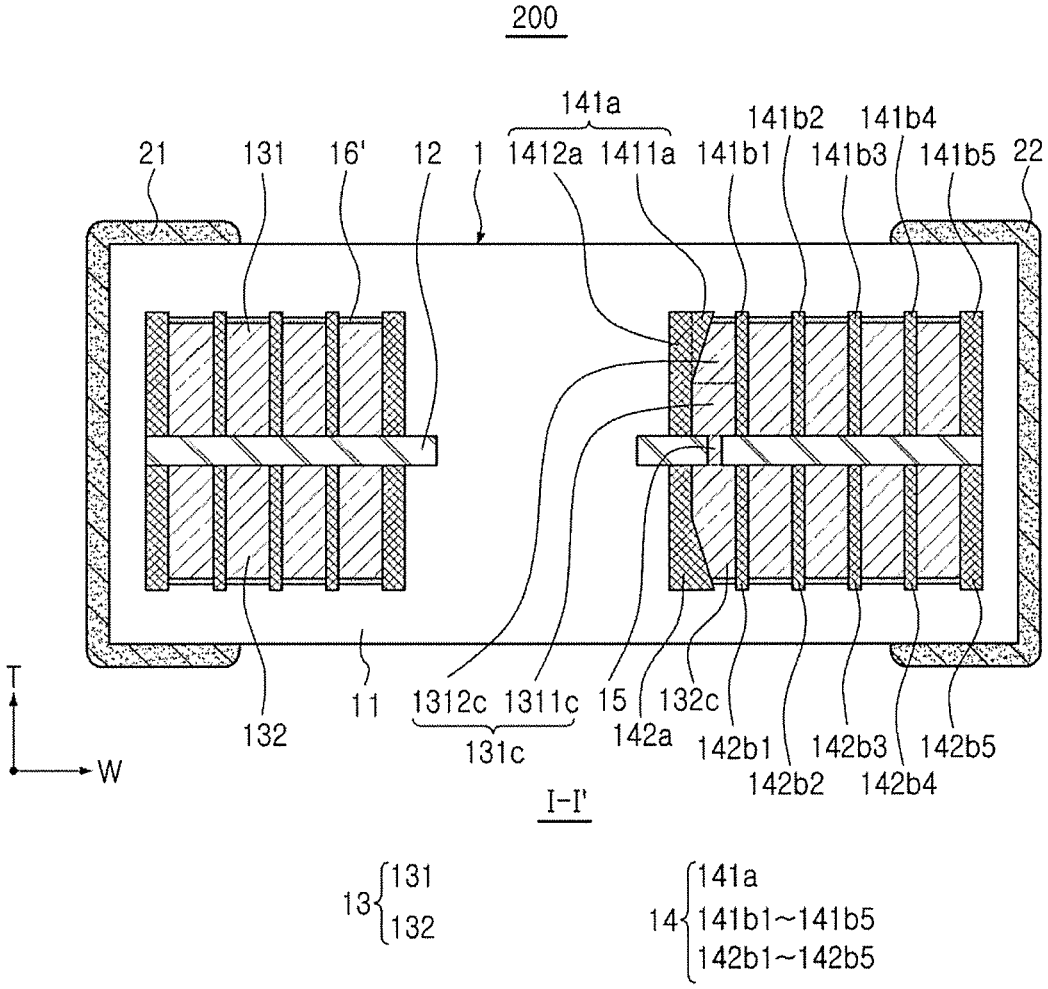
FIG. 4 is a schematic cross-sectional view of a modified example of the thin film type inductor of FIG. 3.

FIG. 4 is a schematic cross-sectional view of a modified example of the thin film type inductor of FIG. 3. A thin film type inductor 200 of FIG. 4 is substantially equal to the thin film type inductor 100 of FIG. 3 except that a shape of an additional insulating part 16' is different. For convenience of explanation, a description of components overlapping those of the thin film type inductor of FIG. 3 will be omitted, and the overlapping components will be denoted by the same reference numerals.

Referring to FIG. 4, the additional insulating part 16' of the thin film type inductor 200 may be formed only on upper surfaces of respective coil patterns. The additional insulating part 16' may be formed only on the upper surfaces of the coil patterns but is not formed on an upper or side surface of an insulating part 14, such that there is no double insulation effect, but a thickness of the insulating layer may be entirely decreased. A spare space in which a magnetic material 11 may be filled may be further secured corresponding to a decrease in thickness of the insulating layer as compared to an inductor having the same size. As a result, permeability of the thin film type inductor may be improved. Here, the additional insulating part 16' has a uniform thickness, and the thickness of the additional insulating part 16' may be preferably 1 μm or more to 10 μm or less. When the thickness of the additional insulating part 16' is thinner than 1 μm, it may be difficult to secure insulation reliability between the coil pattern and the magnetic material 11, and when the thickness of the additional insulating part 16' is thicker than 10 μm, the space in which the magnetic material 11 may be filled may be insufficient. A method of forming the additional insulating part 16' is not limited, but in order to insulate only the upper surfaces of the coil patterns, for example, a method of forming an oxide layer may be applied.

Since the additional insulating part 16' insulates only the upper surfaces of the coil patterns, an upper surface of the insulating part 14 may come in direct contact with the magnetic material 11.

Figure 5:
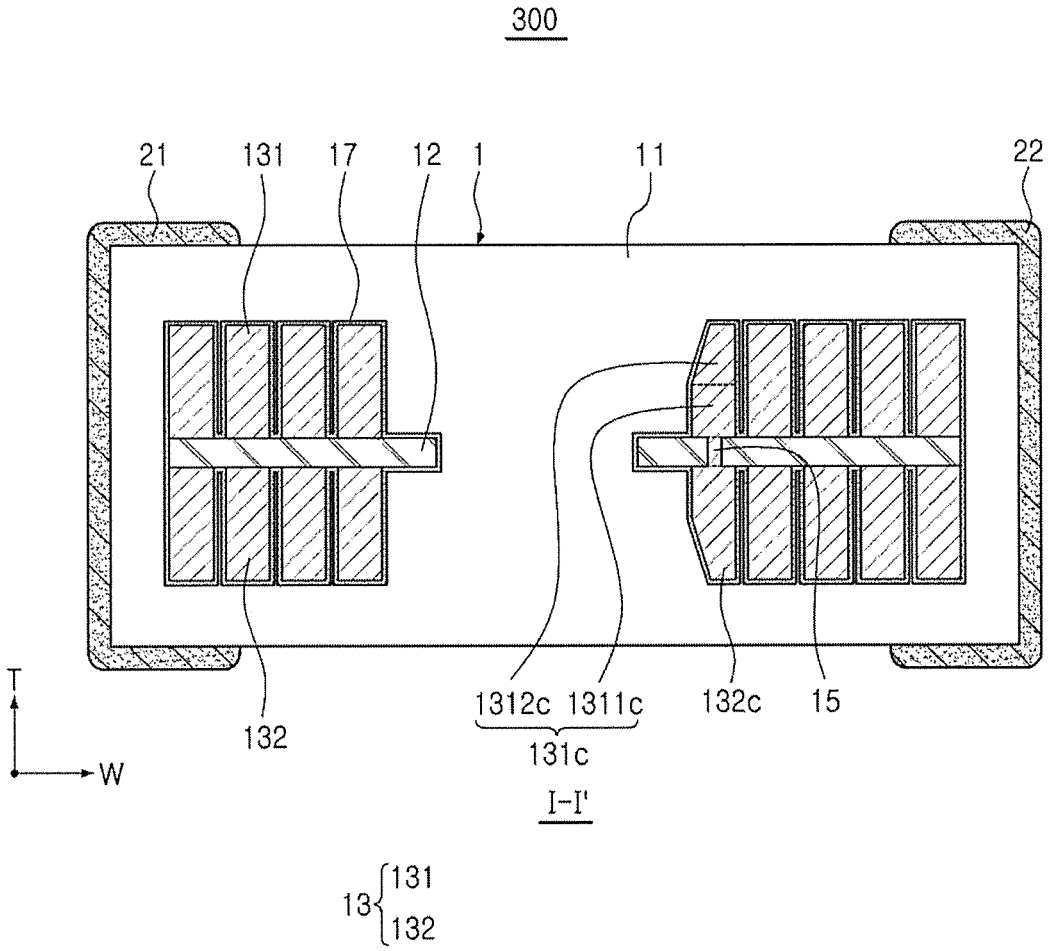
FIG. 5 is a schematic cross-sectional view of another modified example of the thin film type inductor of FIG. 3.

Next, FIG. 5 is a schematic cross-sectional view of a modified example of the thin film type inductor of FIG. 3. A thin film type inductor 300 of FIG. 5 is substantially equal to the thin film type inductor 100 of FIG. 3 except that an insulation structure including an insulating part and an additional insulating part is different. For convenience of explanation, a description of components overlapping those of the thin film type inductor 100 of FIG. 3 will be omitted, and the overlapping components will be denoted by the same reference numerals.

Referring to FIG. 5, an insulator 17 may be disposed along surfaces of coil patterns. The insulator 17 may insulate the coil patterns and a magnetic material 11 from each other while insulating a plurality of coil patterns from each other. A method of forming the insulator 17 is not limited, but for example, the insulator 17 may be formed by depositing a parylene resin, or the like, on the surface of the coil pattern using a chemical vapor deposition method. A thickness of the insulator 17 may be uniformly formed. Here, the term "uniform thickness" means that a width of the insulator insulating between the coil patterns and a thickness of the insulator insulating the upper surfaces of the coil pattern are substantially equal to each other.

A method of forming the insulator 17 is not particularly limited, but in the thin film type inductor 100 of FIG. 3, the insulating part disposed before forming the coil patterns by plating is removed after the coil pattern is formed by the plating and subsequently, the insulator 17 may be formed using a chemical vapor deposition method.

Since the insulator 17 insulates the coil patterns at a relative thin thickness along the surfaces of the coil patterns, a space in which the magnetic material 11 may be filled may be relatively sufficiently secured. Particularly, since the magnetic material 11 as well as the insulator 17 may be disposed on inclined surfaces of upper regions 1312*c* of upper and lower connection patterns 131*c*, 132*c*, respectively, a filling rate of the magnetic material in the vicinity of the center of the core may be increased. Further, in the vicinity of the center of the core, a case in which a flow of a magnetic flux is not smooth due to an increase in magnetic flux density may frequently occur, but the flow of the magnetic flux may be controlled to be optimized along the inclined surfaces of the upper and lower connection patterns 131*c*, 132*c*.

With the above-mentioned thin film type inductor, particularly, a plating deviation of coil patterns may be decreased in a power inductor field requiring an ultra small size and high inductance, and the flow of the magnetic flux in the vicinity of the center of the core and the filling rate may be improved. Since there is no need to add a new process line at the time of deriving the structure of the thin film type inductor, it may be easy to change a design. Requirements for a limit size for preventing the open failure of the via or facility restrictions may be satisfied, and at the same time, a deviation between the coil pattern and the connection pattern connected to the via may be significantly decreased.

As set forth above, according to exemplary embodiments in the present disclosure, the thin film type inductor capable of increasing the filling rate of the magnetic material in the center of the core of the coil and decreasing the plating deviation between the coil patterns by decreasing the size of the coil pattern connected to the via may be provided.

While exemplary embodiments have been shown and described above, it will be apparent to those skilled in the art that modifications and variations could be made without departing from the scope of the present invention as defined by the appended claims.

What is claimed is:

1. A thin film type inductor comprising:

a body including an internal coil including a plurality of coil patterns, a support member supporting the internal coil, and a magnetic material encapsulating the internal coil and the support member, the body having upper and lower surfaces facing each other in a thickness (T) direction, first and second end surfaces in a length (L) direction, and first and second side surfaces in a width (W) direction; and external electrodes disposed on an external surface of the body and electrically connected to the internal coil, wherein the internal coil includes an upper coil and a lower coil disposed on upper and lower surfaces of the support member, respectively, in the thickness direction, the upper and lower coils are connected to each other by a via penetrating through the support member, a plurality of first coil patterns forming the upper coil and a plurality of second coil patterns forming the lower coil include an upper connection pattern and a lower connection pattern, respectively, which are directly connected to the via, at least one of an upper portion of the upper connection pattern and an upper portion of the lower connection pattern includes an inclined surface, and wherein a portion of an insulating part disposed on the inclined surface has a width which increases in a thickness direction.

2. The thin film type inductor of claim 1, wherein each of the upper and lower connection patterns includes an upper region and a lower region, and the upper and lower regions are formed integrally with each other without a boundary line therebetween.

3. The thin film type inductor of claim 2, wherein each cross sectional shape of the upper and lower connection patterns in a width-thickness (W-T) direction is a polygon, and at least one internal angle of the polygon is a right angle.

4. The thin film type inductor of claim 1, wherein a width W1 of an edge of the upper connection pattern coming into contact with the support member is wider than a width W2 of an upper surface of the upper connection pattern in parallel with the support member, and a width W3 of an edge of the lower connection pattern coming into contact with the support member is wider than a width W4 of an upper surface of the lower connection pattern in parallel with the support member.

5. The thin film type inductor of claim 1, wherein a width W2 of an upper surface of the upper connection pattern in parallel with the support member is equal to or less than a maximum width of a coil pattern closest to the upper connection pattern among the plurality of first coil patterns of the upper coil, and a width W4 of an upper surface of the lower connection pattern in parallel with the support member is equal to or less than a maximum width of a coil pattern closest to the lower connection pattern among the plurality of second coil patterns of the lower coil.

6. The thin film type inductor of claim 1, wherein a width W1 of an edge of the upper connection pattern coming into contact with the support member is substantially equal to a maximum width of a coil pattern closest to the upper connection pattern among the plurality of first coil patterns of the upper coil, and a width W3 of an edge of the lower connection pattern coming into contact with the support member is substantially equal to a maximum width of a coil pattern closest to the lower connection pattern among the plurality of second coil patterns of the lower coil.

7. The thin film type inductor of claim 1, wherein the inclined surface inclines toward a center of a core of the internal coil.

8. The thin film type inductor of claim 1, wherein the magnetic material or an additional insulating part is disposed on the portion of the insulating part disposed on the inclined surface.

9. The thin film type inductor of claim 1, wherein the portion of the insulating part disposed on the inclined surface insulates the inclined surface of the upper and lower connection patterns and the magnetic material from each other.

10. The thin film type inductor of claim 1, wherein the portion of the insulating part disposed on the inclined surface is formed of a photosensitive insulating material.

11. The thin film type inductor of claim 1, wherein another portion of the insulating part insulates the plurality of coil patterns from each other.

12. The thin film type inductor of claim 11, wherein a thickness of the insulating part in the width direction disposed between adjacent coil patterns is substantially equal to a thickness of the insulating part in the thickness direction disposed on upper surfaces of the plurality of coil patterns.

13. The thin film type inductor of claim 11, wherein the magnetic material is disposed on the insulating part and in contact with the insulating part.

14. The thin film type inductor of claim 1, wherein the support member includes a through hole penetrating through the upper and lower surfaces thereof, the through hole being disposed at a position spaced apart from the via.

15. The thin film type inductor of claim 14, wherein the through hole is filled with the magnetic material.

16. The thin film type inductor of claim 1, wherein cross sectional shapes of the plurality of coil patterns except for the upper and lower connection patterns in a width-thickness (W-T) direction are tetragons.

17. A thin film type inductor comprising:

a body including an internal coil including a plurality of coil patterns, a support member supporting the internal coil, and a magnetic material encapsulating the internal coil and the support member, the body having upper and lower surfaces facing each other in a thickness (T) direction, first and second end surfaces in a length (L) direction, and first and second side surfaces in a width (W) direction; and external electrodes disposed on an external surface of the body and electrically connected to the internal coil, wherein the internal coil includes an upper coil and a lower coil disposed on upper and lower surfaces of the support member, respectively, in the thickness direction, the upper and lower coils are connected to each other by a via penetrating through the support member, a plurality of first coil patterns forming the upper coil and a plurality of second coil patterns forming the lower coil include an upper connection pattern and a lower connection pattern, respectively, which are directly connected to the via, each of the upper and lower connection patterns includes an upper region and a lower region, the upper region located at a farther side from the support member, the lower region located at a nearer side to the support member and directly connected to the via, and a cross section of the lower region of at least one of the upper and lower connection patterns in a width-thickness (W-T) direction has a rectangular shape, and a cross section of the upper region of at least one of the upper and lower connection patterns in the width-thickness (W-T) direction has a trapezoidal shape, which has a decreasing width in the width direction from the nearer side to the farther side of the support member, wherein a portion of an insulating part disposed on a surface of the trapezoidal shape has a width which increases in a thickness direction.

18. The thin film type inductor of claim 17, wherein a width of the lower region in the width direction is substantially equal to a maximum width of a coil pattern closest to the upper and lower connection patterns among the plurality of coil patterns.

19. The thin film type inductor of claim 17, wherein the upper and lower regions are formed integrally with each other without a boundary line therebetween.

* * * * *